US007708917B2

(12) United States Patent
Järvinen et al.

(10) Patent No.: US 7,708,917 B2
(45) Date of Patent: May 4, 2010

(54) METHOD AND APPARATUS FOR CASTING CONCRETE ELEMENTS

(75) Inventors: Lassi Antero Järvinen, Valkeakoski (FI); Aimo Tapio Seppanen, Sääksmäki (FI)

(73) Assignee: Elematic Oy AB, Toijala (FI)

( * ) Notice: Subject to any disclaimer, the term of this patent is extended or adjusted under 35 U.S.C. 154(b) by 522 days.

(21) Appl. No.: 10/965,910

(22) Filed: Oct. 18, 2004

(65) Prior Publication Data

US 2005/0084555 A1 Apr. 21, 2005

(30) Foreign Application Priority Data

Oct. 20, 2003 (FI) ..... 20031534

(51) Int. Cl.
*E04B 1/16* (2006.01)
*B28B 3/00* (2006.01)

(52) U.S. Cl. ..... 264/33; 264/34; 264/69; 264/71; 264/299; 264/333; 425/63; 425/64; 425/380; 425/456; 425/468; 249/184; 249/185; 249/186

(58) Field of Classification Search ..... 425/64; 264/33, 34, 70, 71, 297.9
See application file for complete search history.

(56) References Cited

U.S. PATENT DOCUMENTS

| | | | | |
|---|---|---|---|---|
| 1,191,731 | A * | 7/1916 | Ransome | 425/59 |
| 2,734,248 | A * | 2/1956 | Gaudin | 425/59 |
| 3,523,343 | A * | 8/1970 | Mitchell | 425/88 |
| 3,862,736 | A * | 1/1975 | Herro | 249/65 |
| 3,877,860 | A | 4/1975 | Putti | |
| 4,229,153 | A | 10/1980 | Hight, Jr. | |
| 4,457,682 | A * | 7/1984 | Nash et al. | 425/219 |
| 4,668,447 | A * | 5/1987 | Paakkinen | 264/70 |
| 4,773,838 | A * | 9/1988 | Seppanen | 425/63 |
| 5,023,030 | A * | 6/1991 | Rantanen | 264/40.5 |
| 5,123,831 | A | 6/1992 | Enqvist et al. | |
| 2007/0138703 | A1 * | 6/2007 | Ojanen | 264/333 |

FOREIGN PATENT DOCUMENTS

| | | | |
|---|---|---|---|
| EP | 0 517 505 A1 | | 12/1992 |
| EP | 1 188 528 B1 | | 3/2002 |
| FI | 19991792 | | 2/2001 |
| WO | WO0110615 | * | 2/2001 |
| WO | WO 01/14114 | | 3/2001 |
| WO | WO 01/14114 A1 | | 3/2001 |

* cited by examiner

*Primary Examiner*—Jeffrey Wollschlager
(74) *Attorney, Agent, or Firm*—Buchanan Ingersoll & Rooney PC

(57) ABSTRACT

A method and apparatus for casting concrete elements with varying, determined length, equipped with one or with a plurality of longitudinal hollow cores, by means of a slip-forming apparatus. The apparatus is movable with respect to the bed (2), said apparatus comprising forming members (10) for forming hollow cores. The mass is fed in the first step to the portion of the slab below the hollow cores, and in the second step the hollow-core forming members being brought onto the said portion of the slab and mass is being fed between the forming members and onto them. The forming member (10) for forming a hollow core comprises an attachable extension part (22). The height of a hollow core is changed by changing the extension part of the hollow core forming member.

8 Claims, 3 Drawing Sheets

METHOD AND APPARATUS FOR CASTING CONCRETE ELEMENTS

BACKGROUND

1. Field

Disclosed herein is a method and an apparatus for casting concrete beams or concrete elements including one or more hollow cores by slipforming.

2. Description of Related Art

Slipforming is a method generally used for casting concrete elements. Casting of beams can be performed by using between walls between the products to be cast, and casting of hollow-core elements including hollow cores can be performed by using hollow-core tubes. The casting is typically performed in two steps. The mass forming the lower portion of the hollow-core slabs is fed in the first step onto the casting bed before the hollow-core tubes are put in place. When the hollow-core tubes are in their places, the mass to form the upper portion of the slab is fed onto the tubes and between them. A traditional way is to cast by slipforming a long uniform cast piece, which after hardening is sawn into parts with desired length. Respectively, the casting of beams is performed in two steps. The mass of concrete mixture is first fed to form the lower portion of the beam, and when the feeding point of the mass for the upper part reaches its location, the mass to form the upper part of the beam will be fed.

In slipforming, the heights of the products to be cast are determined according to the loads to be exerted to the products. The portion of the hollow cores of the volume of the slab is as large as possible, taking into account the strength requirements for the slab, in order to produce a slab as light as possible and to minimize the amount of the raw material. The amount and number of hollow cores in the slab varies usually so, that in a low slab there is a plurality of smaller cores and along with increasing the height of the slab of the same width, the number of the hollow cores is decreased and their diameter is increased.

One and the same slipforming apparatus is usually used for products with different heights. When the size of the product to be cast is changed, typically the whole hollow-core tube series, in other words the mandrel series, of the slipforming apparatus is changed into a tube series corresponding the amount and/or size of the hollow cores of the other product to be cast. At the same time the mass compacting members are changed, as well to correspond to the amount and/or size of the mandrels. Correspondingly, also the side walls for forming the edges of the slab have to be changed in accordance with the requirements for the new height of the product to be cast, for example in order to change the location or shape of the longitudinal groove to be formed to the upper edge of the slab. Changing work is quite time-consuming and after the change, the slipforming apparatus has to be readjusted for the new product height. As the height of the products to be cast can vary quite a lot and the lots to be produced can be relatively small, the settings of the apparatus, especially the hollow-core forming members, must be simply and quickly changeable for different products.

SUMMARY

With the method described herein, the changing work and time for changing the hollow-core forming members, due to a change in the size of the hollow core to be cast, will only be a fraction of those of the traditional method. In the method described herein, only a part of the height of the hollow-core forming members is changed by changing only their extension parts. Because the hollow-core forming member will not be changed along its total length, the apparatus need not be demounted along its total length. Advantageously, the amount of the hollow cores and thus the amount of the hollow-core forming members remains unchanged when changing the hollow core height at a certain slipforming apparatus. The height of the hollow cores will be usually changed when the height of the product to be cast is changed. In addition, the compacting means for the cast of the upper part is adjusted to a correct height in accordance with the product. If necessary, a dowel bar is attached to the sidewalls of the slipforming apparatus, if the form of the edge of the product so requires. With a dowel bar a longitudinal groove can be formed on the side walls of the concrete element.

The apparatus described hereinincludes a hollow-core forming member comprising a basic part and a detachable extension part. The extension part is attached so, that it can be detached and remounted quickly to the basic part of the hollow-core forming member. Thus, when the size of the hollow core is changed, which usually happens when the height of the product is changed, only the extension part of the hollow-core forming member is changed, onto which and on the sides of which the mass for forming the upper part of the slab is fed, whereby the number of the device components to be changed is significantly smaller than in the devices of prior art.

The required changing work can be performed without demounting the casting apparatus further, e.g. without detaching the hollow-core forming members from their supports, whereby it, being a fast measure, can be made quite often, which increases the production flexibility of the factory significantly. Additionally, an advantage is maintaining the adjustments or settings, whereby the casting of a new product can be started quickly and reliably. In addition, less material for the machine parts is needed, as only a part of the hollow-core forming member is changed, and advantageously, the compacting members for the mass of the lower part of the slab need not be changed when the size of the hollow core is changed.

BRIEF DESCRIPTION OF DRAWINGS

The method and apparatus will be described in more detail in the following, with reference to the enclosed drawing, wherein.

DETAILED DESCRIPTION OF SPECIFIC EMBODIMENTS

Figure 1:
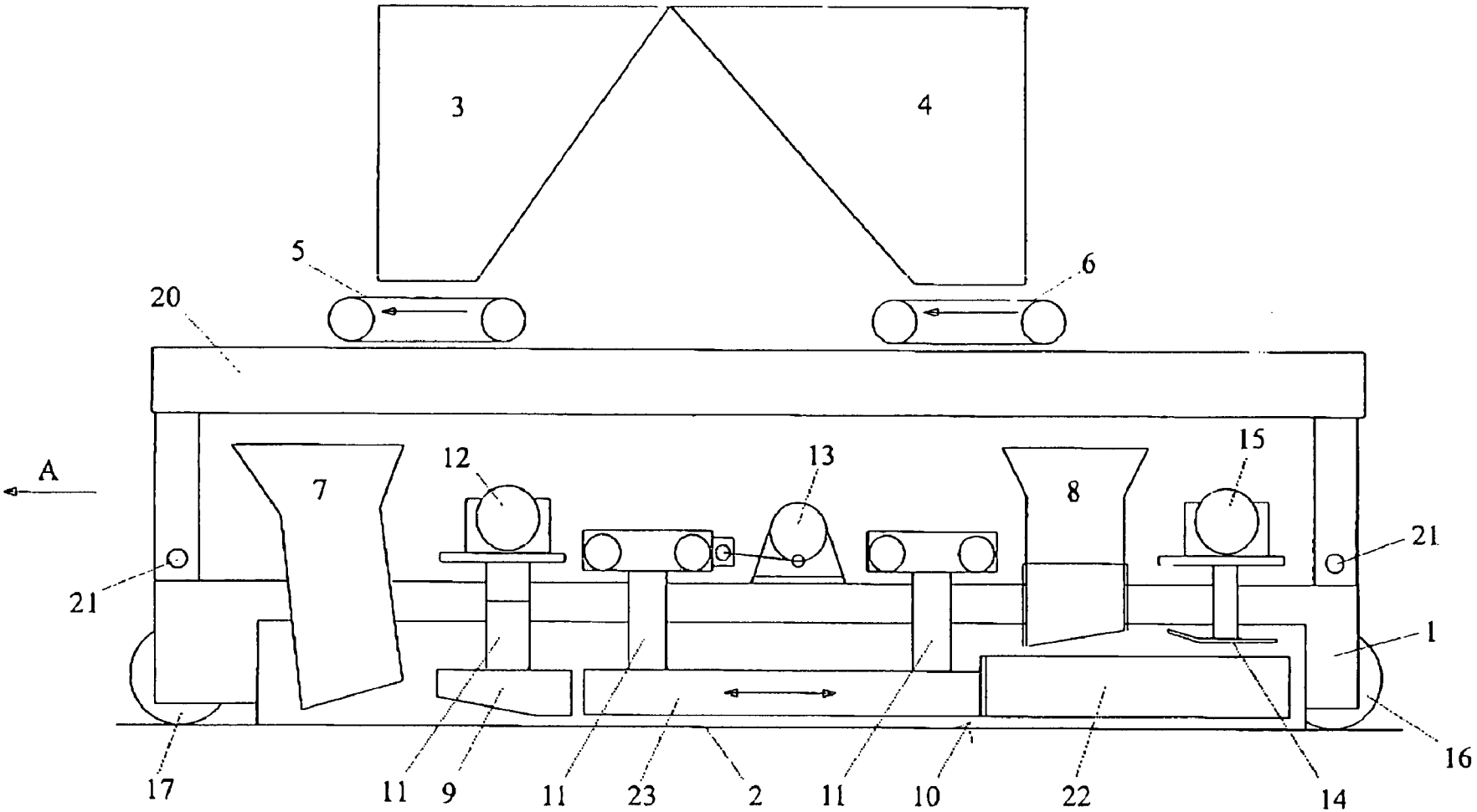
FIG. 1 shows an apparatus in accordance with an embodiment described herein as a schematic side view.

In an embodiment of the apparatus (FIG. 1) described herein, the frame 1 of the casting unit is movable with respect to the bed 2 in the direction of arrow A, along typically an immovable bed supported by the supporting wheels 16 and drive wheels 17. The drive wheels are connected by means of a roller chain to the actuator (not shown). Vertical position or location of the frame 1, i.e. its distance from bed 2, is adjustable in relation to the wheels 16, 17. Two feeding containers 3 and 4, and below these the belt conveyors 5 and 6 feeding concrete mass to the feeding funnels 7 and 8, are supported to the frame 20 of the detachable upper part. The upper part is connected to the casting unit by means of locking pins 21. One preferred embodiment of the equipment comprises means for attaching the pre-stressing cables.

For forming the hollow cores the apparatus comprises parallel, tube-like vibrating shoes 9 having an inclined lower part, so that their front ends are upper than their back ends, being vibrated by means of a vibrator 12, and behind them there are parallel hollow-core forming members 10. A hollow-core forming member 10 comprises a hollow-core tube 23 and its extension 22. Vibrating shoes 9 and the hollow-core tube 23 are supported from their upper part to the frame 1 by means of supporting irons 11. The hollow-core tube 23 and its extension 22 are fitted or attached to each other so that they are substantially on the same level with each other as well at their bottom surfaces and side surfaces. On the rear end of the equipment there is an upper plate 14, which is vibrated by means of a vibrator 15. Driven by a motor 13 the tube-like hollow-core forming members 10 additionally move continuously back and forth in the longitudinal direction so, that each hollow-core forming member moves in the opposite direction to the direction of the adjacent hollow-core forming member.

Figure 2:
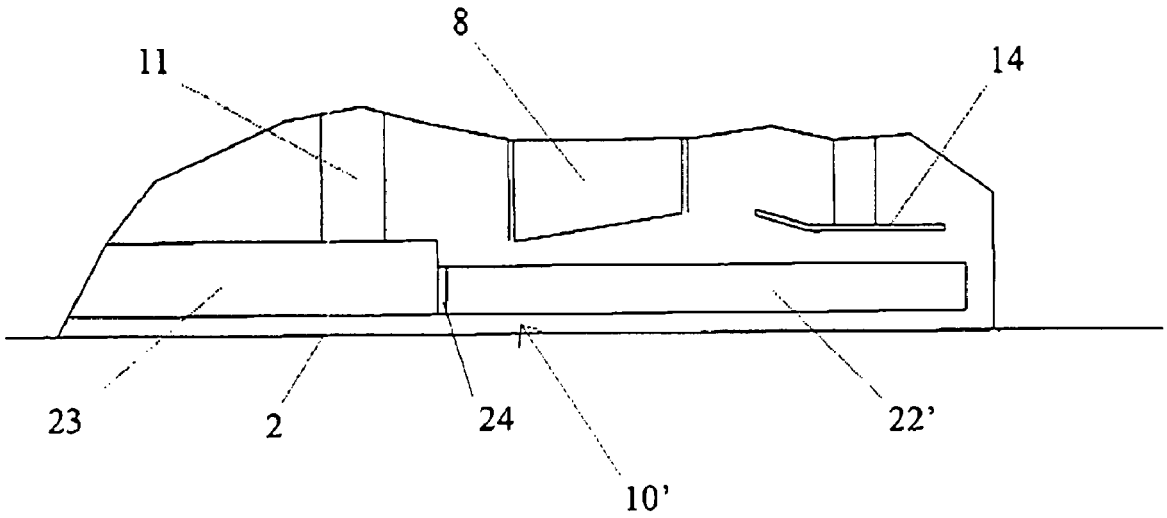
FIG. 2 shows a partial cut of the apparatus shown in FIG. 1, with another preferred embodiment of the hollow-core forming member as a schematic side view.

FIG. 2 shows another preferred embodiment of a tube-like hollow-core forming member 10', comprising basic part 23 and its extension 22'. The height of the extension part 22, 22' can be bigger, smaller or the same as the height of the basic part 23. However, it is essential that the outer surface of at least the lower part of the basic part 23 is aligned with the outer surface of at least the lower part of the extension part 22, 22' attached to it. By the term lower part is meant in this context the part of the forming member 10, especially of the basic part 23, which defines the shape of the lower part of the slab before the mass or concrete mixture for the upper part of the slab is fed between and onto the hollow-core forming element 10, in FIG. 1 from the feeding funnel 8

The diameter of the extensions 22 at the jointing line 24 is preferably not larger than the diameter of the basic part 23. In one advantageous embodiment the diameter of the extensions 22 at the jointing point is the same as that of the hollow-core tubes 23. The height of the extension 22 preferably corresponds with the height of the hollow core of the product to be cast.

The hollow-core tube extensions 22 are preferably fast attachable as extensions to the hollow-core tubes 23 so that they are easily detachable and mountable. In the extension there is, for example, a shaft that will be placed into a respective tube formed into the hollow-core tube 23 corresponding to the shaft. The locking arrangement of the hollow-core tubes can simply comprise a locking pin extending from the surface of the basic part 23 of the hollow-core forming member to the hole in the shaft of the extension part 22 of the hollow-core forming member being partly inside the former. In one preferred embodiment the extension part 22 is attached or locked to the basic part 23 by means of a screw or screws.

Figure 3:
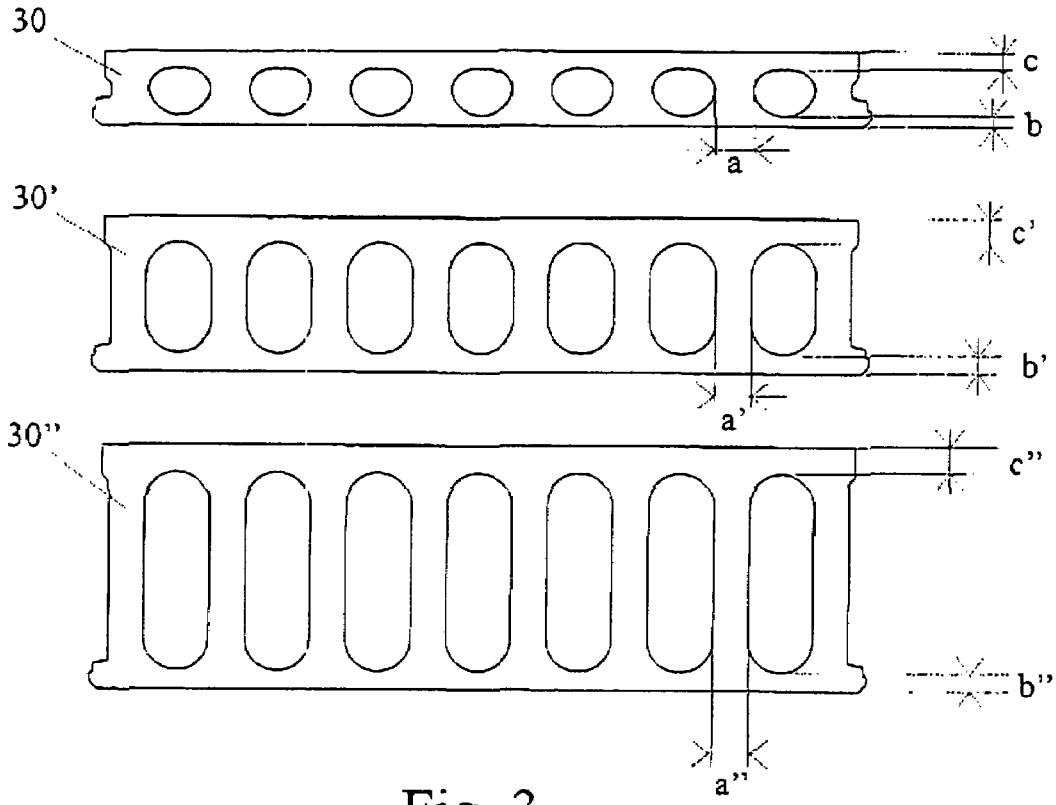
FIG. 3 shows a cross-sectional view of a series of concrete slabs formed with an embodiment of a method described herein.

FIG. 3 shows a series of concrete slabs (30, 30', 30") formed with one preferred embodiment described herein. The heights of the concrete slabs are different, increasing from 30 to 30". As the height of the slab to be produced increases, the number of the hollow cores is kept the same, but the height of the hollow cores formed is increased. This is achieved in the method and apparatus described hereinby using the same basic part of the hollow-core forming mandrel and changing the extension part of the hollow core forming mandrel. The extension part defines the height of the hollow core to be formed.

In FIG. 3 the form of the lower surfaces of the corresponding hollow cores of the slabs 30, 30' and 30" formed using the same basic parts of the hollow-core forming members is the same. Often the maximum width of the hollow cores formed using the same basic part is the same, as is the case for slabs 30' and 30" and the thickness of the neck a', a" between adjacent hollow cores remains the same from one slab to another slab. In a special case of a slab 30 with a lower height and thus with lower hollow-cores, the maximum width of the hollow cores formed is smaller and thus the width a is larger than for slabs 30' and 30". This is possible because for a lower slab the amount of concrete mix needed to be fed in the first step and thus the thickness of the concrete layer b under the hollow cores is usually smaller than the respective thickness b', b" for higher slabs.

Figure 4:
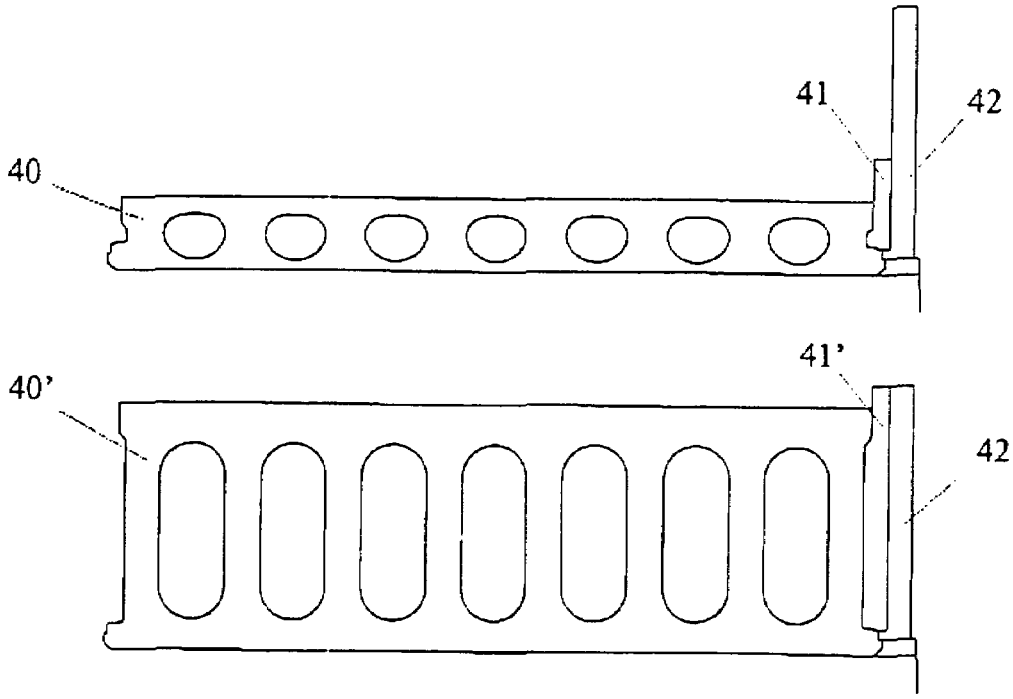
FIG. 4 shows a cross-sectional view of concrete slabs with different heights and vertical positioning of dowel bars according to one preferred embodiment described herein.

FIG. 4 shows a cross-sectional view of two concrete slabs (40, 40') with different heights. When the height of the product to be cast which will comprise a longitudinal groove on the sides of the product to be cast, the mold side wall 42 need not be changed Instead, dowel bars 41, 41' of different shape and/or height are changed and used for different concrete products 40, 40'. Dowel bars are advantageously attached to the mold side wall by means of screws.

The method and apparatus are applicable not only for casting of hollow-core slabs but also for forming beams. When beams, especially I-beams or T-beams, are cast using the method or apparatus described herein, the tube-like hollow core forming mandrels are replaced with forming elements which separate the beams to be formed. The side profile of such a forming element defines the form of the beam cast.

When casting the hollow-core slabs, the equipment in accordance with the invention is operated as follows:

Concrete mass for forming the bottom portion of the slab is fed onto the bed 2 for the portion of the slab below the hollow-core tubes from the first feeding funnel 7. The casting apparatus moves in the casting direction with respect to the bed supported by the supporting wheels 16 and driving wheels 17. Vibrating shoes 9 vibrate the concrete mixture below the vibrating shoes dense. From the rear feeding funnel 8 the concrete mass is fed between the hollow-core extensions 22 and onto them. Concrete mass may be fed also between a part of the hollow-core tubes 23 and onto a part of them.

Continuing the casting, the upper plate 14 compacts the upper surface of the slab by means of the vibrator 15. The back and forth moving hollow-core forming members 10, comprising the hollow-core tubes 23 and their extensions 22 attached to each other also perform shear compaction, thus compacting the mass to form the necks between the hollow cores.

When one wants to change the size of the hollow core of the product to be cast, which is in general the case when the height of the cast product changes, only the rear part of the hollow-core forming member 10 will be changed. This is achieved by changing the extension 22 of the hollow-core tube. The height of the extension 22 to be changed can be equal to the height of the hollow-core tube 23 or smaller or bigger than that. The height of the hollow core to be formed is defined by the height of the extension 22. Preferably, the number of the hollow cores and thus the number of the hollow-core forming members 10 is not changed. Thereby also the number of the vibrating shoes 9 remains unchanged, as only the height of the hollow cores changes. The extensions 22 of the hollow-core tubes are chosen and attached to the hollow-core tubes 23 so that the lower surfaces and side surfaces of the forming members 10 are substantially at the same level. The attaching and locking points of the hollow-core tubes 23 and their extensions 22 are located preferably before the rearmost feeding funnel 8. In one preferred embodiment, the attaching point of the hollow-core tubes 23 and the extensions 22 thereof is on the different side of the rearmost support of the hollow-core forming member 10 than the locking point of the hollow-core tubes 23 and the extensions 22.

In a method in accordance with a preferred embodiment described herein, a dowel bar can be located to the sidewall of the slipforming apparatus for forming a groove to the sidewall of the slab to be formed. This kind of a groove can be needed for example for lifting the slab after being cast. In accordance with a preferred embodiment described herein, the length of the dowel bar is shorter than the length of the slipforming apparatus. The dowel bar has preferably a length of not more than the length of the hollow-core tube extension 22. The location of the dowel bar in the vertical direction is preferably changed when the height of the product to be slipformed changes.

The vertical position of the vibration shoe 9 and the hollow core forming members 10 is adjusted according to the requirements of the product cast. Their bottom surfaces are advantageously at the same level. The position of the said members is for example set by adjusting the vertical location of the frame 1 relative to the wheels 16, 17. At the same time the vertical position of the first feeding funnel 7 is changed. When the height of the product to be cast is changed, the vertical position of the upper plate 14 is changed separately. The vertical position of the second feeding funnel 8 is also separately adjustable. In one preferred embodiment of the method, the products to be cast are pre-stressed by using strand-cables.

In slipforming of beams described herein, the form of the profile of the forming element 10 and a dowel bar used defines the form of the profile of the beam, for example an I-beam or a T-beam, to be formed. When slipforming beams, advantageously a hollow core inside a product is not formed. Advantageously the hollow-core forming members 10 act as walls separating the beams to be cast. Advantageously the bottom surface of the forming members 10 extend to substantially to the surface of the bed 2 and their top surface to substantially top or higher than the top of the beams to be formed. In the latter case the upper plate 14 for compacting the upper surface of the cast products is formed of several plates in the direction of the width of the casting bed. In one preferred embodiment the bottom surface of the forming element 10 is substantially straight, not curved.

When casting beams, the basic part of the hollow core forming element defines the profile of a lower part of a beam and with changeable extension parts the form and/or height of the upper part of the beam can be varied. The distance of vibrating shoe 9 and the hollow core forming member 10 from the forming bed 2 are adjusted according to the requirements of the beams to be cast. Advantageously said distances are adjusted so that a neck is not formed below the hollow core forming member I0. Advantageously from the first feeding funnel 7 concrete mixture is fed between the basic parts of the forming element 10.

The invention having been thus described by reference to its specific embodiments, it is noted that the embodiments do not limit the scope of the appended claims.

The invention claimed is:

1. A method for casting at least two batches of (1) multiple beams with determined length that may vary between batches or (2) a hollow core slab with a determined length that may vary between batches, said slab having more than one longitudinal hollow core, the method comprising:

(a) using a slipforming apparatus movable with respect to a bed, said apparatus comprising:

(i) forming members for forming beam profiles or hollow cores, said members being supported at their upper portion, each forming member comprising a basic part and an extension part attached to the basic part, and (ii) side walls for forming the edges of the beams or hollow core slab, (b) preparing a first batch by:

(i) feeding a mass to form the lower portion of the beams or of the hollow core slab, and (ii) bringing the forming members onto the lower portion of the beams or the slab and additional mass being fed between and onto the extension parts, wherein the heights of the hollow cores are determined by the heights of the extension parts or wherein the heights and/or form of the beams is determined by the heights of the extension parts, (c) modifying the forming members by detaching only one or more extension parts of the forming members and attaching one or more extension parts with a different size, (d) preparing a second batch by:

(i) feeding a mass to form the lower portion of the beams or of the hollow core slab, and (ii) bringing the forming members onto the lower portion of the beams or the slab and feeding additional mass between and onto the extension parts of the forming members, wherein the heights of the hollow cores are determined by the heights of the extension parts of the forming members or wherein the heights and/or form of the beams is determined by the heights of the extension parts of the forming members, wherein the second batch has a difference in the height(s) of the hollow cores or the height(s) and/or form of the beams resulting from the changed one or more extension parts of the forming members.

2. A method according claim 1, wherein the apparatus includes compaction members for the mass of the lower portion.

3. A method according to claim 2, wherein when the one or more extension parts of the forming members with a different size are changed, the number of the compaction members for the mass of the lower portion is not changed.

4. A method according to claim 1, wherein a dowel bar is attached to a sidewall to form a longitudinal groove to a beam or slab.

5. A method according to claim 4, wherein the location of the dowel bar in the vertical direction is changed when the height of the beam or slab to be cast is changed.

6. A method according to claim 4, wherein the length of the dowel bar is not more than the length of the extension part of the forming member.

7. The method of claim 1, wherein the length of the slab or beams of each batch is longer than the lengths of the extension parts.

8. The method of claim 1, wherein the lower part of each extension part is aligned with the lower part of the basic part to which the extension part is attached.

* * * * *